US006790092B2

(12) United States Patent
Parsadayan et al.

(10) Patent No.: US 6,790,092 B2
(45) Date of Patent: Sep. 14, 2004

(54) MODULAR TERMINAL BLOCK WITH SURGE PROTECTION

(75) Inventors: Walter Parsadayan, Lake Forest, CA (US); Daniel Perez, Foothill Ranch, CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/218,442

(22) Filed: Aug. 13, 2002

(65) Prior Publication Data

US 2004/0033712 A1 Feb. 19, 2004

(51) Int. Cl.[7] ..... H01R 25/00
(52) U.S. Cl. ..... 439/650; 361/118
(58) Field of Search ..... 439/650, 709; 361/118, 119, 728

(56) References Cited

U.S. PATENT DOCUMENTS

| | | | | | |
|---|---|---|---|---|---|
| 4,738,632 | A | | 4/1988 | Schmidt et al. | 439/632 |
| 5,504,645 | A | | 4/1996 | Hinrichsen et al. | 361/120 |
| 5,526,225 | A | * | 6/1996 | Wang | 361/643 |
| 5,629,831 | A | | 5/1997 | Eggert et al. | 361/624 |
| 5,690,511 | A | * | 11/1997 | Melito | 439/502 |
| 5,696,820 | A | | 12/1997 | Pelegris et al. | 379/399 |
| 5,722,862 | A | | 3/1998 | Glathe et al. | 439/709 |
| 5,775,955 | A | | 7/1998 | Graube et al. | 439/717 |
| 5,786,987 | A | | 7/1998 | Barbier et al. | 631/732 |
| 5,902,140 | A | * | 5/1999 | Cheung et al. | 439/139 |
| 6,222,717 | B1 | | 4/2001 | Waas et al. | 361/119 |
| 6,259,173 | B1 | | 7/2001 | Dias et al. | 307/147 |
| 6,273,729 | B1 | * | 8/2001 | Kelly | 439/36 |
| 6,410,994 | B1 | * | 6/2002 | Jones et al. | 307/36 |
| 6,475,008 | B1 | * | 11/2002 | Marolda et al. | 439/271 |

* cited by examiner

*Primary Examiner*—Tulsidas C. Patel
(74) *Attorney, Agent, or Firm*—Fitch, Even, Tabin & Flannery

(57) ABSTRACT

A modular terminal block with one or more built in surge protectors is disclosed. The terminal block contains all of the surge protection devices for a security or other type of system. The connectors of the terminal block also have indicia on the connector pairs of the terminal block that match the connectors of the terminal block with the connectors of the system to which the surge protector is to be connected. The identifying indicia on the connectors pairs provides for the easy identification of the proper interconnections between the terminal block and the system it is designed to protect.

18 Claims, 5 Drawing Sheets

MODULAR TERMINAL BLOCK WITH SURGE PROTECTION

FIELD OF THE INVENTION

The present invention relates to protection of a security system from power surges, more particularly it relates to an apparatus for the efficient and quick replacement of surge protection devices.

BACKGROUND OF THE INVENTION

Security systems for controlling accesses to a restricted area are in common use today. Apartment complexes, gated communities; individual residences; office complexes; factories; and research facilities often have these systems. Typically, the system consists of one or more gates located at various entrances to the restricted area, which require the entry of a code into a communication unit located at the gate or calling a person on the communication within the restricted are in order to have the gate opened and thus allow access. Some systems also use radio transmitters that communicate with a transponder located in a vehicle arriving at the gate to identify whether the party has authority to enter. These systems also include gate operators or controllers, gate motors as well dedicated computer systems to control the operation and functioning of the system.

Most security systems in common use today have units located in the open or other areas where they are exposed to the natural elements and other potential hazards. These include security gates with all of the auxiliary systems necessary for the gate to operate including a gate motor, gate controller, local communication unit, dedicated computer system with software for the system to properly function, etc. One of the more common hazards such units are exposed to are power surges from lighting strikes, errant power line surges or the like. In fact damage or disablement of security system as a result of a power surge has been a persistent problem since the advent of movable barrier security systems.

In the past some manufactures, if they use surge protectors at all, relied on standard type of surge protection devices made for general-purpose use. These devices typically come in a simple package. Although these surge protection devices protect the system from power surges when such episodes occur the power surge often results in the burn out of the surge protection device either by design or simply as a result the magnitude and extent of the surge. In such situations it is necessary for a technician to service the unit to replace the burned out surge protectors. This entails identifying the burned out surge protectors, disconnecting them from the system, replacing them and connecting the new surge protector into the system. Since these problems can frequently occur the need to send a highly trained technician out to the site to conduct the repair adds significantly to the cost of repair. Given the complexity of the typical security gate unit, which as noted, not only includes a motor and gate controller, but sensors to detect the presence of a vehicle, a dedicated computer and communication units, multiple disconnections will have to be made after the affected surge protectors are identified and reconnections made upon replacement. Any errors in making the disconnections or reconnections can result in an inoperative system. Additionally, the technician generally has to know which surge protector or protectors have blown due to an over load in order to know which type of surge protectors to take when making the service call on the disabled unit. Surge protectors that are incorporated into a standard terminal block have been available for years. However, installation of a standard terminal block with surge protections circuitry incorporated into it also requires a trained technician to complete installation in order to assure all of the correct connections have been made. Thus although, use of standard terminal blocks that incorporate surge protection devices has been common with various types of electrical equipment for years, given the complexities of the systems they are used with they still require a trained technician fully familiar with the equipment being serviced to assure proper installation.

Thus, what is needed is an efficient and economical method and apparatus to facilitate the manufacture, repair and replacement of surge protectors on security units that have been disabled by transient power or lightening induced surges. A method and apparatus that can replace burned out surge protectors and ready the unit for continued use that does not require the presence of a highly trained technician and that can be accomplished by a person without significant training including the owner of the unit.

SUMMARY

It is an objective of the present invention to provide a method and apparatus to facilitate the repair and replacement of burned out surge protectors in and efficient and economical manner. It is yet another objective of the present invention to provide a method and device that will allow the repair and replacement of a surge protector by a relatively untrained individual. It is yet a further aspect of the present invention to provide a surge protection apparatus that is both durable and cost efficient to manufacture.

The present invention accomplishes these and other objectives by providing a modular terminal block having: a) a first set of modular connectors that make detachable conductive connections with components of a security system control unit; b) a second set of modular connectors that make detachable conductive connections with peripheral components of the security system, each connector of the second set of modular connectors being conductively linked to a specified connector of the first set of modular connectors through at least one surge protection device; c) wherein the first set of connectors are specifically identified for connection with at least one connector of the security system control unit and second set of connectors are specifically identified for connection with a connector of at least one peripheral device of the security system to thereby provide for ease in connecting and disconnecting the modular terminal block; and d) wherein the first and the second set of connectors with surge protection there between form a compact modular terminal block that can be easily attached or removed from the security system.

BRIEF DESCRIPTION OF THE DRAWINGS

The invention will be better understood by an examination of the following description, together with the accompanying drawings, in which.

DETAILED DESCRIPTION OF THE PREFERRED EMBODIMENT

Figure 1:
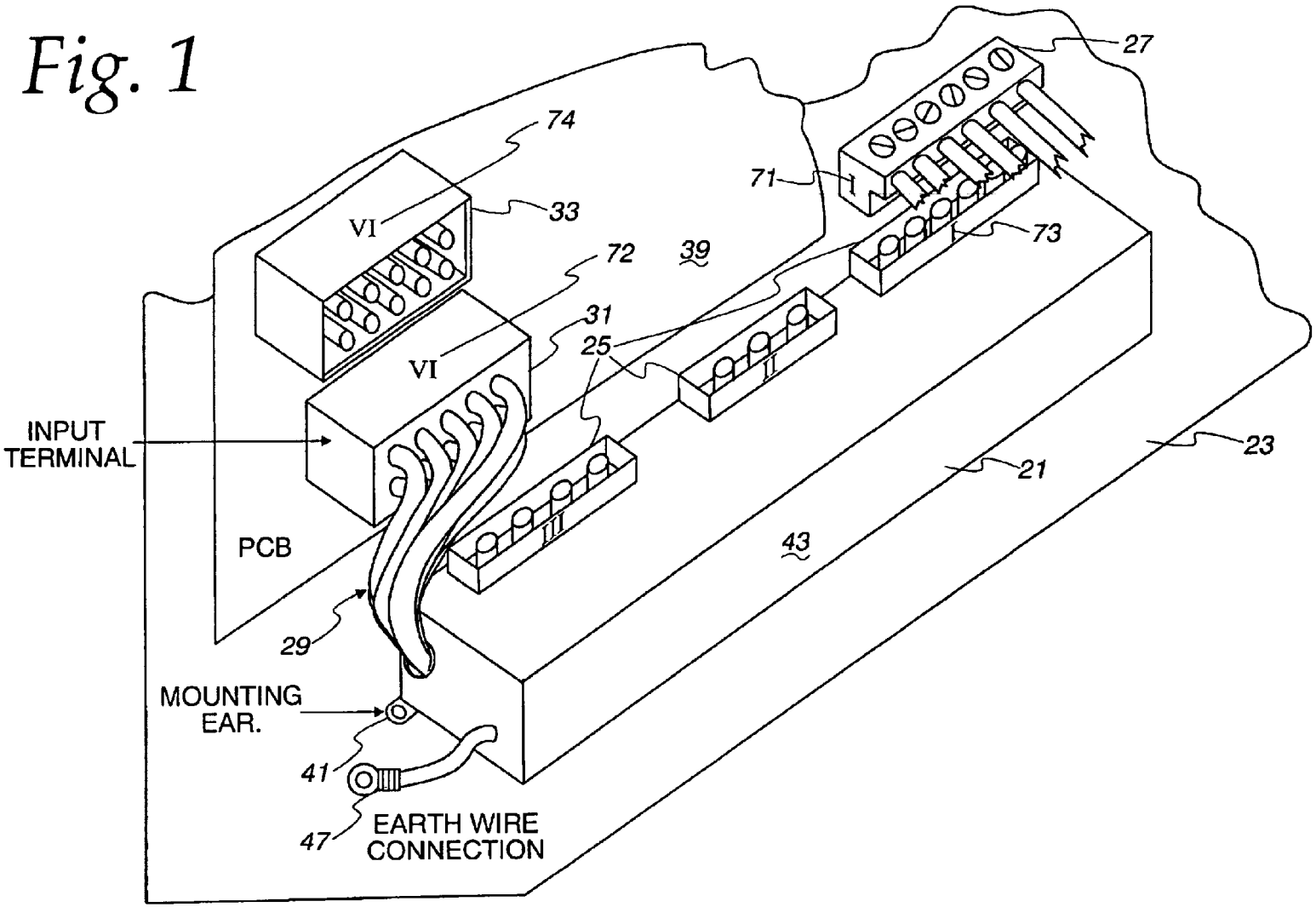
FIG. 1 shows a preferred embodiment of a surge protector terminal block made according to the present invention.

FIG. 1 presents a perspective view of a combination terminal block surge protector made according to the present invention. The terminal block 21 with surge protectors incorporated is attached to housing 23 of the gate controller and related devices. Along its top, terminal block 21 has various connection receptors 25. These connection receptors are designed to receive connection plugs 27 from various external units that are not shown. These include power sources, various external sensors and a separate communication unit if in fact the communication unit is separate from the gate controller, etc.

Terminal block 21 also has its own connection via lines 29 and plug 31 to outlet 33 on circuit board 39, in the example shown a gate operator control board. Terminal block 21 is attached in a securely but removable fashion by mounting eyelet 41 that forms a part of the terminal housing 43. Eyelet 41, and a duplicate of which is located on the opposite side of housing 43, but not shown, are secured to the housing 23 of the gate controller and related devices by standard sheet metal screws. Other means of connection of the terminal block to the unit are of course possible. Terminal block 21 also has a ground connection 47 to complete the connection of the various surge protection devices located in terminal block 21.

Circuit board 39 is a typical circuit board of a security gate operator in that it has the circuitry of the gate controller, a dedicated computer with appropriate memory and other related devices mentioned above and hereafter. It also has detection device analyzers that interpret signals from detection devices located within the area of the security gate, such as magnetic loop detectors. As soon as a change in the field of the loop detector is sensed the analyzers send an appropriate signal to the computer, and the computer, running special software generates the correct system response. Drawings of the items discussed in this paragraph are not included since they are in general well understood in the art. Thus, a number of sophisticated units are located in the gate controller housing that are highly susceptible to power surges and require substantial protection from such power surges.

Figure 2:
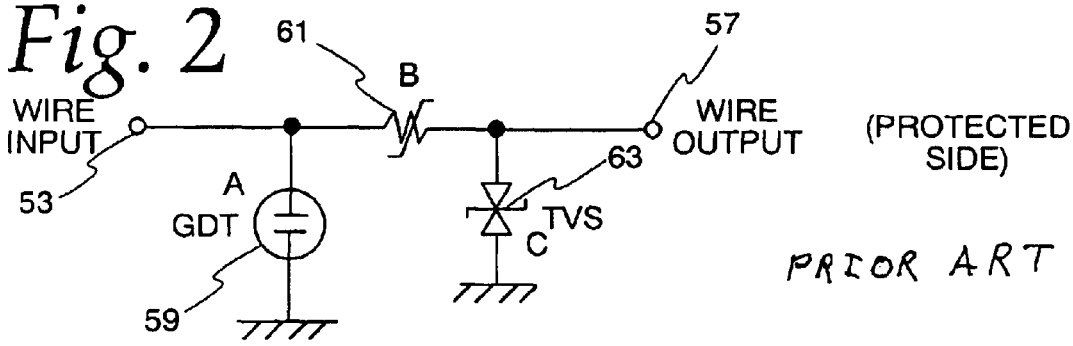
FIG. 2 provides a simple schematic diagram of known surge protector circuits.
Figure 3A:
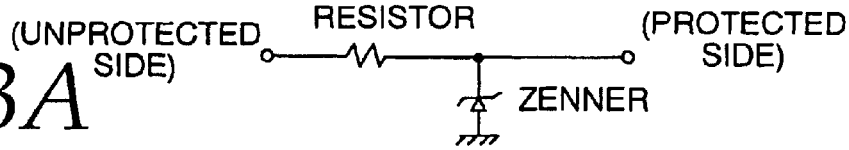
FIGS. 3A to 3G provide schematic diagrams of various simple surge protection circuits that the present invention might employee.
Figure 3B:
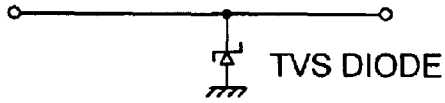
Figure 3C:
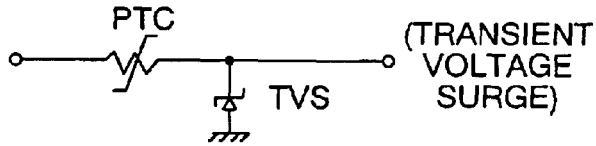
Figure 3D:
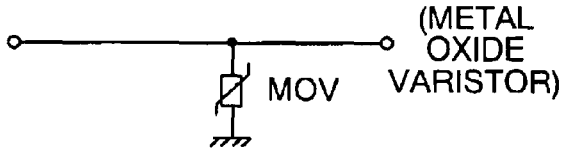
Figure 3E:
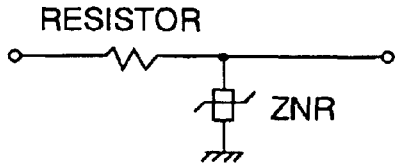
Figure 3F:
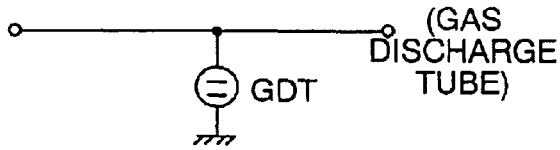
Figure 3G:
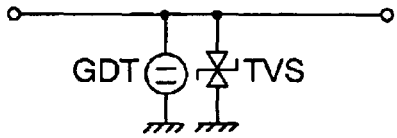

FIG. 2 provides a simple schematic type of diagram of one version of the surge protection circuitry that would be contained in terminal block 21. Input of power and/or sensing signals or other signals from other units of the system would be at input point 53. Input point 53 corresponds to connector pairs 25–27 (FIG. 1). On the opposite side of input point 53 is output point 57 that corresponds to connector set 31-33 that connect into the gate operator or other unit to be protected. In between the two points are gas discharge tube 59, positive thermal coefficient device, 61 and transient voltage surge protection diode 63 that form the surge protection circuitry. The circuit shown in FIG. 2 is well known in the technology of surge protection devices. A description of the operation of the circuit in FIG. 2 is unnecessary since those skilled in the art are fully familiar with how it functions. FIGS. 3A to 3G provide schematic diagrams of a variety of other simple surge protection circuits that could be incorporated into the terminal bock of the present invention. In FIGS. 3A to 3G the left side of the schematic is the unprotected side and the right side of the schematic is the protected side. The devices schematically depicted in FIGS. 3A to 3G are: FIG. 3A a TVS diode, FIG. 3B a transient voltage diode, FIG. 3C transient voltage diode working in conjunction with a PTC device (positive thermal coefficient), FIG. D is a metal oxide varistor, FIG. 3E a zinc nonlinear resistor diode, FIG. 3F a gas discharge tube and FIG. 3G a gas discharge tube working in conjunction with a TVS type diode. However, the examples provided are only a sample of the types of surge protection circuits that could be used in the present invention and not meant to limit the possible alternatives for surge protection circuits. Any variety of other surge protection circuits could be used.

Figure 4A:
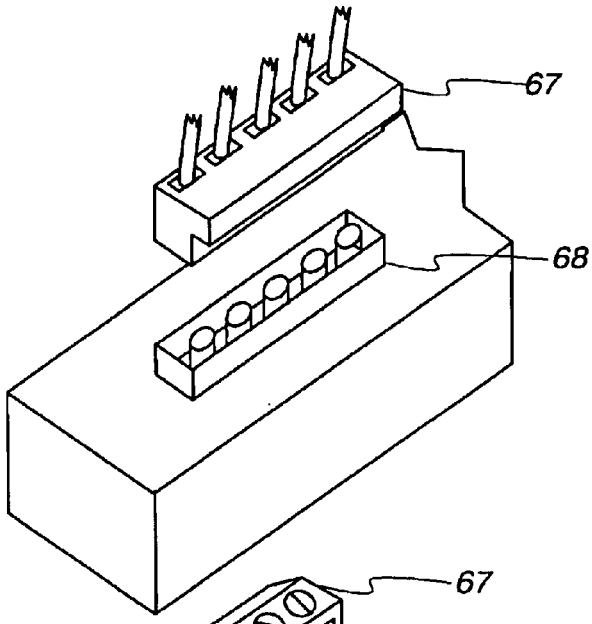
FIGS. 4A to 4C depict different types of electrical connectors that might be used in the unit of the present invention.
Figure 4B:
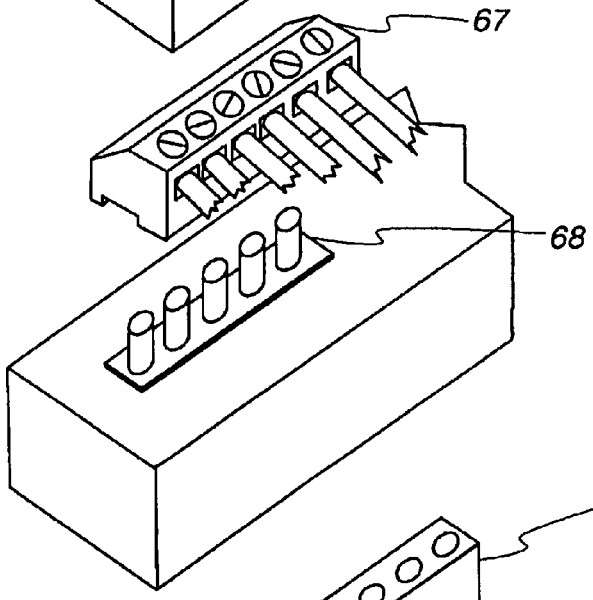
Figure 4C:
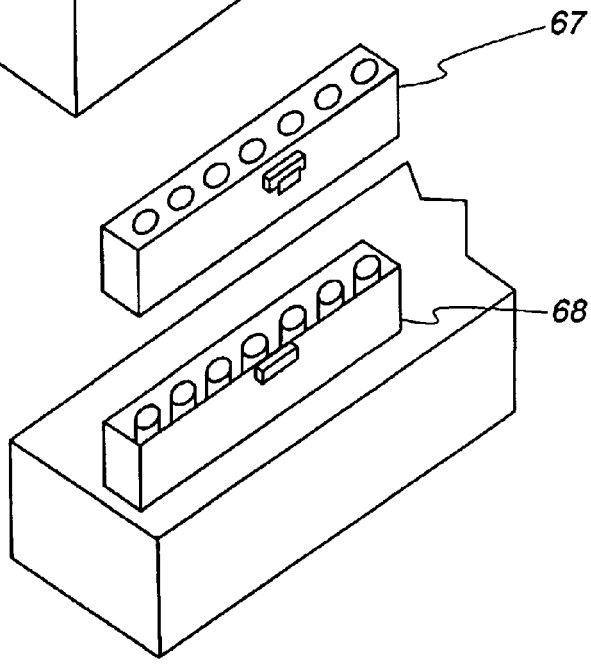

A wide variety of electrical connectors could be used with the present invention. A simple male female connector with multiple prongs could be used. As an optional feature male and female connectors could be used that form water impervious seals for the reasons noted below. FIGS. 4A, 4B and 4C provides a view of various types of quick connect and disconnect electrical connectors that could be used in the present invention. In FIGS. 4A, 4B and 4C plug 67 would connect to pinheadeer 68. Among other types of possible connectors are the following: 5 mm terminal block connector, a screw type of connector, single connector, quick disconnect terminal connector, RS 485 connector and modular clamp connectors. The proceeding is only a sampling of the possible electrical connectors that could be used with the present invention. Those skilled in the art, once they have read this specification and understand the concepts of the present invention will readily see that it could be practiced with a wide variety of other types of electrical and electronic connectors.

In an alternate embodiment of the invention the connectors could form water impervious seals such as seals 203 (FIG. 6D) when connected to electrical connectors of the security system control unit and the peripheral devices. Additionally, the terminal block would have a water impervious housing. The terminal block housing could be made of strong durable plastic like material or of metal with appropriate seals to make it water impervious. Thus, when the terminal block and its connectors are connected into to a security system it would form sealed electrical connections and not be subject to shorting due to dampness caused by water present when it rains or from other sources of water such as sprinkler systems etc. This could be of significance in certain applications where the terminal block of the present invention might be used in a wet or damp locations.

Figure 5:
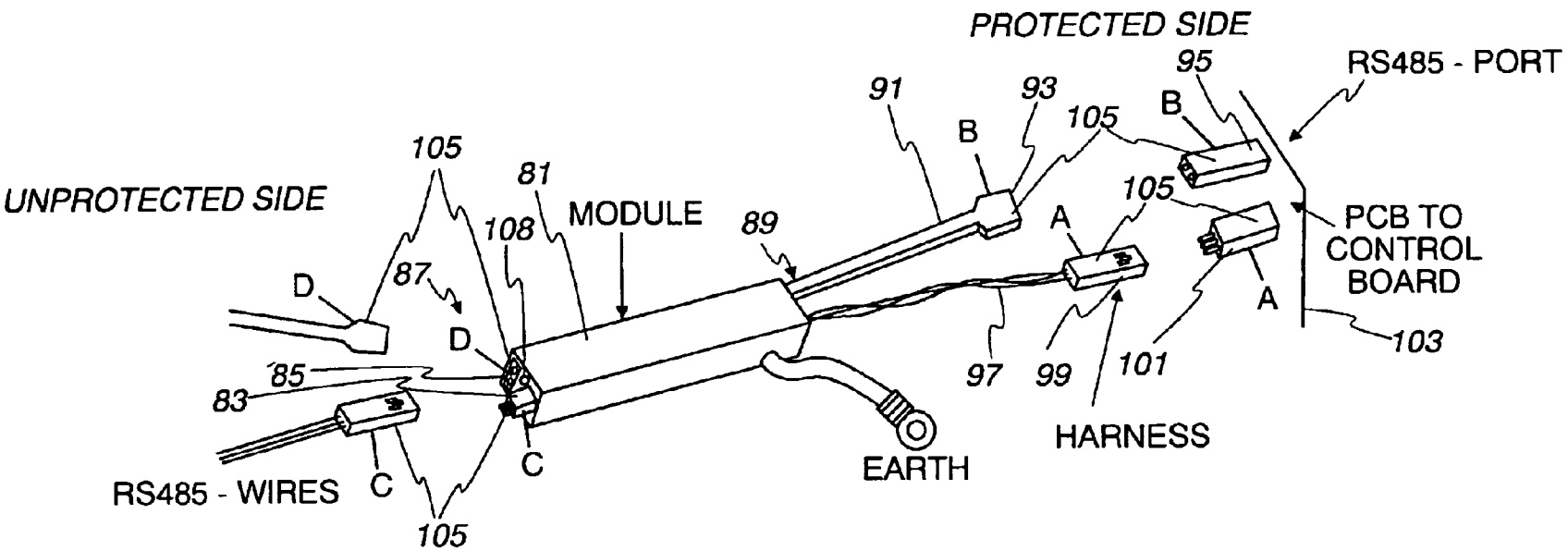
FIG. 5 is an example of another terminal block made according to the present invention.

Although the above description describes use of the terminal block of the present invention with a gate controller, computer and related circuitry it can just as easily be used with other stand alone devices that make up the local security system. This would include communication devices that make up part of the system. U.S. Pat. No. 5,854,831, incorporated herein by reference, provides an example of another stand-alone communication unit with which the invention could be used. This patent is owned by a company related to the owner of this application, which are both commonly owned. FIG. 5 provides one example of such a device that could be used to protect the communication unit described in the '831 patent. In FIG. 5 terminal block 81 at its unprotected side has two input connectors a RS 485 connector and a DC or AC power input 85 depending on the power source for the communication unit. On its protected side terminal block 81 has a power cord 91 and connector 93 that would connect to the power line terminal connector 95 of the communication unit. Likewise terminal block 81 has RS 485 line 97 and RS 485 connector 99 that connects to the RS 485 connector 101 of the communication unit. In the example provided both connectors 95 and 101 are located on a PCB board 103 of the communication unit. Power line 107 and RS 485 line 109 would connect to the terminal block 81 at connectors 85 and 83 respectively to connect the communication unit to rest of the system and to the local phone system. Terminal block module 81 also has a ground connection to complete the surge protection circuit of terminal block 81. A surge protection circuit similar to the ones depicted above would be included in terminal block 81. As can be seen terminal block 81 could be easily installed or removed from the unit. In addition identifying indicia 105 are on all of the connectors to facilitate the correct connection of the terminal block into the system. Although the example uses a communication unit that uses an RS 485 connection and protocols other types of communication protocols could be just as easily used.

Figure 6A:
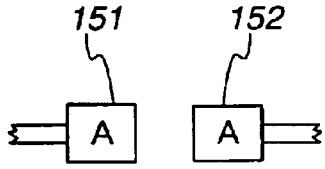
FIGS. 6A–6C depict various type of indicia used to match up the correct connectors in their proper pairs.
Figure 6B:
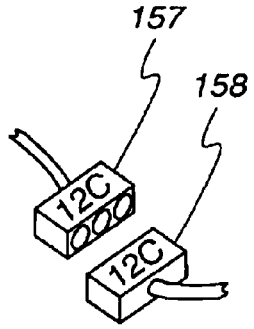
Figure 6C:
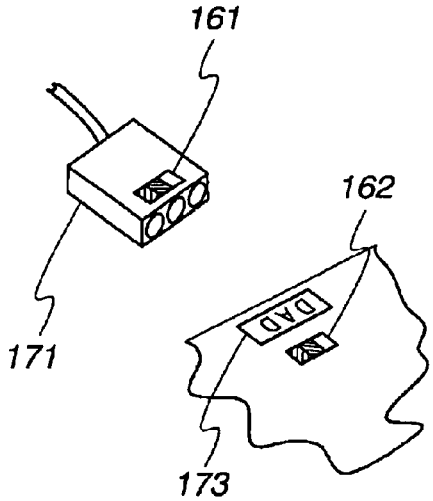
Figure 6D:
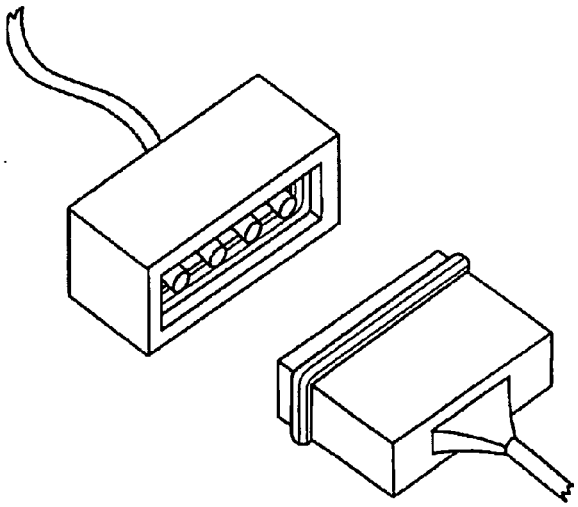
FIG. 6D depicts modular connectors with seals.

One of the unique features of the present invention is the inclusion of indicia on the various paired set of connectors of the first set 31–33 that connects terminal block 21 to the security system controller unit and the connectors of the second set 25–27. The indicia allow a quick and effective matching up of the connectors in their correct pairs. The identifying indicia can consist of numbers, letters, alphanumeric code, color-coding, roman numerals or virtually any type of identifiable coding. FIG. 6A depicts connectors 151 and 152 with a single letter A used as the indicia to indicate they are to be connected to each other. In FIG. 6B it is a combined alphanumeric code 12C is used to match up connector 157 and 158. In FIG. 6C color-coding illustrated by hatched lines 161 and 162 are used to indicate that connectors 171 and 173 are to be connected to each other.

The terminal block of the present invention is thus designed to be rugged and easy to install and replaced without the need for special training on the system itself. If a surge causes an overload of the local circuits the circuitry of terminal block 21 will, as described above, protect the circuitry and units of the gate controller and related devices and/or independent units including communications devices. However, the severity of the surge may cause one or more of the surge protection circuits to burn out and thus require their replacement. Since all of the surge protection circuits are located in terminal block 21 all that has to be replace is terminal block 21. Removal of terminal block 21 simply involves 1) the disconnection of the plugs 27 and 31, 2) disconnection of ground 47 and removal of screws from eyelet 41, as well as the eyelet on the opposite side of terminal block 21 and 3) lifting out the burnout terminal block 21. Replacement of the terminal block simply entails: 1) attaching a replacement terminal block in the same position as the one removed, 2) insertion of the screws into the eyelets 41 etc., 3) connection of the ground of the new terminal block at 47, 4) reconnection of connectors 27 and 31 of the new terminal block. Connectors 27 and 31 in a preferred embodiment would have identifying indicia on them 71 and 72 respectively that match them up with indicia 73 and 74 of outlets 25 and 33 respectively. Thus, a highly trained technician does not need to service the unit when all that is necessary is the replacement of the surge protection systems.

While the invention has been particularly shown and described with reference to a preferred embodiment thereof, it will be understood by those skilled in the art that various changes in form and detail may be made to it without departing from the spirit and scope of the invention.

We claim:

1. A modular terminal block comprising:

a first set of modular connectors that make detachable conductive connections with components of a security system control unit;

a second set of modular connectors that make detachable conductive connections with a plurality of different peripheral components of the security system, each connector of said second set of modular connectors being conductively linked to a specified connector of said first set of modular connectors and protected by at least one surge protection device;

wherein said first set of connectors are specifically identified for connection with at least one connector of the security system control unit and second set of connectors are specifically identified for connection with a connector of at least one of the plurality of different peripheral devices of the security system to thereby provide for ease in connecting and disconnecting said modular terminal block; and wherein said first and said second set of connectors and their associated surge protection form a compact modular terminal block that can be easily attached or removed from the security system.

2. The apparatus of claim 1 wherein the modular aspect of each connector of said first set connectors is that they each have plug type of connectors for connecting a specific component of the security system to said terminal block and said second set of connectors have plug type of connectors for connecting each connector of said second set of connectors to a specific peripheral component of a security system to thereby electronically and electrically link up an entire local security system into a functioning local security system.

3. The apparatus of claim 1 wherein said surge protection devices are drawn from one or more of the following group: gas discharge tubes, TVS diodes, metal oxide varistor.

4. The apparatus of claim 1 wherein each of said first set of connectors is are specifically identified for connection to at least one connector of said security system control unit by indicia.

5. The apparatus of claim 4 wherein said indicia is drawn from the group of letters, numbers, roman numerals, alpha numeric code and color code.

6. The apparatus of claim 1 wherein said second set of connectors are specifically identified for connection to at least one peripheral device of said security system by indicia.

7. The apparatus of claim 6 wherein said indicia is drawn from the group of letters, numbers, roman numerals, alpha numeric code and color code.

8. The apparatus of claim 1 wherein said security system control unit is a gate operator.

9. The apparatus of claim 1 wherein the peripheral devices to which said second set of connectors is conductively connected are drawn from the two or more of the following: group loop detectors, communications units, power sources, external sensors.

10. The apparatus of claim 1 wherein said first set of connectors is a single multiple connection connector which attaches to a single multiple connection receptor, said receptor being conductively attached to the components of said security system control unit.

11. The apparatus of claim 10 wherein said single multiple connection connector and said single multiple connection receptor form a detachable water impervious seal to thereby prevent shorting of the security system.

12. The apparatus of claim 1 wherein said detachable conductive connections between said second set of connectors and said peripheral devices form detachable water impervious seals when connected to thereby prevent said security system from shorting out.

13. The apparatus of claim 1 wherein said detachable conductive connections between said second set of connectors and said peripheral devices are formed by connectors drawn from a group of: mate female type of plug, 5 mm terminal block connector, a screw type of connector, single pinheader connector, quick disconnect terminal connector, RS 485 connector and modular clamp connectors.

14. The apparatus of claim 1 wherein said modular terminal block is a water impervious housing.

15. The apparatus of claim 14 wherein when said modular terminal block and its first set of connectors are conductively connected to said security control unit and second set of connectors are conductively connected to said peripheral devices said modular terminal block and first and second set of connectors form a water impervious sealed connections between said security control unit and said peripheral devices.

16. A modular terminal block comprising:

a first set of connectors that make detachable conductive connections with components of a security system control unit;

a second set of connectors that make detachable conductive connections with a plurality of different peripheral components of the security system, each connector of said second set of connectors being conductively linked to a specified connector of said first set of modular connectors and protected by at least one surge protection device;

wherein each connector of said first set of connectors is identified for connection with at least one connector of the security system control unit and second set of connectors are identified for connection with a connector of at least one of the plurality of different peripheral devices of the security system to thereby provide for ease in connecting and disconnecting said modular terminal block; and wherein said first and said second set of connectors and their associated surge protection form a compact modular terminal block that can be easily attached or removed from the security system.

17. The apparatus of claim 16 wherein said security system control unit is gate operator.

18. The apparatus of claim 16 one wherein the peripheral devices to which said second set of connectors is conductively connected are drawn from the two or more of the following: group loop detectors, communications units, power sources, external sensors.

* * * * *